United States Patent [19]

Gusack et al.

[11] 4,422,224

[45] Dec. 27, 1983

[54] APPARATUS FOR INTERLACING MULTIFILAMENT YARN

[75] Inventors: James A. Gusack, Williamsburg, Va.; David O. Bird, Arnprior, Canada; Ernest C. Thomm, Sarnia, Canada; William A. Reitz, Renfrew, Canada

[73] Assignee: Badische Corporation, Williamsburg, Va.

[21] Appl. No.: 331,868

[22] Filed: Dec. 17, 1981

[51] Int. Cl.[3] ..... D02G 1/16; D02J 1/08

[52] U.S. Cl. ..... 28/272; 28/274

[58] Field of Search ..... 57/333, 350; 28/271, 28/272, 274, 275, 276

[56] References Cited

U.S. PATENT DOCUMENTS

| | | | |
|---|---|---|---|
| 3,525,133 | 8/1970 | Psaras | 57/333 X |
| 4,069,565 | 1/1978 | Negishi et al. | 28/275 |
| 4,152,886 | 5/1979 | Nelson | 28/274 X |

FOREIGN PATENT DOCUMENTS

| | | | |
|---|---|---|---|
| 46-13169 | 4/1971 | Japan | 28/275 |
| 47-34252 | 8/1972 | Japan | 28/274 |

*Primary Examiner*—Robert Mackey

*Attorney, Agent, or Firm*—George F. Helfrich

[57] ABSTRACT

Provided is a body member having two planar orthogonal yarn-treating faces. Secured to the body member is a cover member having a coacting surface which is either (a) planar or (b) concave, partial conical. The coacting surface of the cover member is spaced from the first of the yarn treating faces to form a yarn passageway. A pair of fluid conduits is provided in the body member, one conduit terminating perpendicularly to each of the yarn treating faces in an orifice therein which is positioned to direct fluid against the surface of the cover member. Fluid is supplied to the conduits from a suitable source, and a mechanism is provided for controlling the velocity and direction of travel of a multifilament yarn into and out of the yarn passageway, most desirably in a traversing movement.

3 Claims, 6 Drawing Figures

APPARATUS FOR INTERLACING MULTIFILAMENT YARN

BACKGROUND OF THE INVENTION

1. Field Of The Invention

This invention relates generally to the manufacture of textile yarns. In particular, it relates to an apparatus for the fluid jet interlacing of multifilament yarns.

2. Prior Art Statement

There has been a long-standing need in the industry for an apparatus which will produce a coherent textile yarn bundle at high rates of speed without twisting. As-spun or zero twist yarns, without sufficient coherency, perform poorly in many common textile operations, such as winding, tufting, weaving, and knitting, as a result of the looseness of the structure of these yarns. Such a lack of coherency is responsible for snagging and breaking of individual filaments, which causes the formation of slubs, wraps, and the like. As a consequence, producers or processers of textile yarn generally carry out the additional step of twisting the yarn in order to provide an acceptable starting product. Twisting, which serves to compact and unify a yarn bundle, is an expensive and time-consuming operation which, usually performed with frequent interruptions, adds disproportionately to the cost of the yarn.

Over the years a number of expedients have been proposed, some of the more noteworthy of which are those disclosed in the following U.S. Pat. Nos. 3,262,179; 3,455,096; 3,110,151; 4,011,640; and 4,035,883. The closest prior art is considered to be U.S. Pat. No. 3,262,179, which discloses an apparatus for interlacing multifilament yarn which includes a body member providing a yarn-treating face and having a vortex cavity in said face. Cooperating with the body member is a well member having a planar surface spaced from the yarn treating face to form a yarn passageway. Yarn guide means controls the direction of yarn travel through the passageway, and a pair of fluid conduits are provided in the body member, terminating at opposite sides of the vortex cavity in the yarn treating face and positioned to direct fluid against the surface of the well member.

In contradistinction to the device disclosed in this reference, the device of the present invention does not employ a vortex chamber in a yarn treating face of the body member. Instead, the particularly defined configuration of the present invention results in the yarn passageway itself being a type of "vortex chamber". This results in enhanced interlacing effectiveness in operation, at reduced fluid energy consumption, nd facility in the manufacture of the device itself.

SUMMARY OF THE INVENTION

According to the present invention, a device is provided comprising the following coactive components:

(a) a body member having two planar orthogonal yarn-treating faces;

(b) a cover member secured to the body member, the cover member having a coacting planar surface which is spaced from the first yarn-treating face to form a yarn passageway, the coacting surface of the cover member so positioned with respect to the yarn-treating faces that an angle of about 45 degrees is formed by the intersection of: (1) a line resulting from the intersection of the coacting surface and any plane mutually orthogonal to the coacting surface and to the yarn-treating faces and (2) a line resulting from the intersection of said orthogonal plane and the second yarn-treating face;

(c) means for controlling the velocity and direction of travel of a multifilament yarn into and out of the yarn passageway;

(d) a coactive pair of fluid conduits in the body member, one conduit terminating perpendicularly to each of the yarn-treating faces in an orifice therein which is positioned to direct fluid against the coacting surface of the cover member, the longitudinal axes of the conduits at the terminations thereof lying in a plane mutually orthogonal to the coacting surface and to the yarn-treating faces; and (e) means for the supply of fluid to the conduits.

The above cooperative combination of components is conveniently referred to hereinafter as a "yarn treating element".

As an alternative "yarn treating element" there is provided:

(a) A body member having two planar orthogonal yarn-treating faces;

(b) A cover member secured to the body member, the cover member having a coacting, concave, partial conical surface which is spaced from the first yarn-treating face to form a yarn passageway, the coacting surface so positioned with respect to the yarn-treating faces that an angle of about 45 degrees is formed by the intersection of: (1) a line resulting from the intersection of the coacting surface and any plane passing through the conical axis of the coacting surface; and (2) a line resulting from the intersection of said plane passing through the conical axis of the coacting surface and the second yarn-treating face;

(c) Means for controlling the velocity and direction of travel of a multifilament yarn into and out of the yarn passageway;

(d) A coactive pair of fluid conduits in the body member, one conduit terminating perpendicularly to each of the yarn-treating faces in an orifice therein which is positioned to direct fluid against the coacting surface of the cover member, the longitudinal axes of the conduits at the terminations thereof lying in a plane mutually orthogonal to the coacting surface and to the yarn-treating faces; and (e) Means for the supply of fluid to the conduits.

In both of the yarn treating elements detailed above, it is especially advantageous if the means for controlling the velocity and travel of the yarn effects a traversing movement of the yarn into and out of the yarn passageway.

An especially preferred embodiment of the present invention comprises at least one of the "yarn treating elements" detailed above in cooperative combination with the following additional elements to produce a pulley or interlacer roll:

(1) A disc having a circumferential groove formed in the periphery thereof so that the groove of the disc is aligned with the yarn passageway(s) of the yarn-treating element(s) positioned on the periphery of the disc, whereby the natural entrance of the yarn into and exit from the pulley effects a traversing movement of the yarn into and out of the yarn passageway(s) of the yarn-treating element(s); and (2) Means for causing the pulley to rotate, and the yarn to advance longitudinally at substantially the same velocity as the groove of the disc.

BRIEF DESCRIPTION OF THE DRAWINGS

For a more complete understanding of the present invention, reference should be made to the Detailed Description of the Preferred Embodiments, which is set forth below. This description should be read together with the accompanying drawings, wherein.

DETAILED DESCRIPTION OF THE PREFERRED EMBODIMENTS

Figure 1:
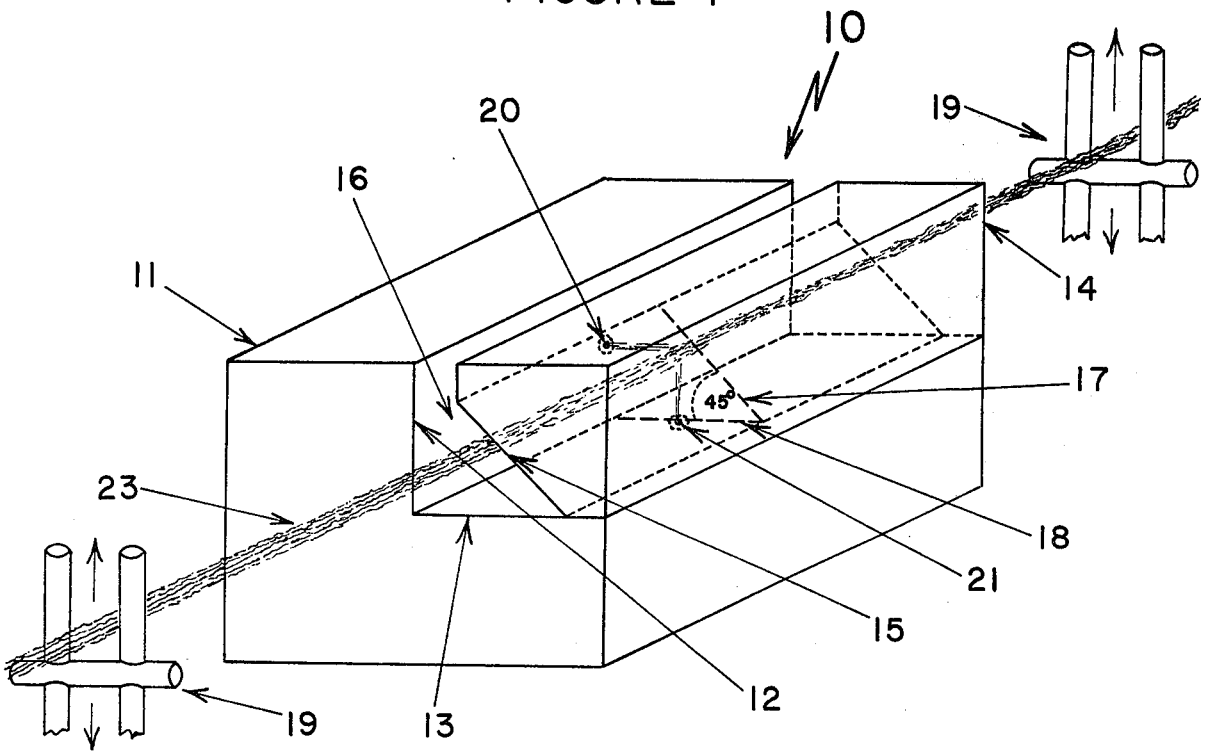
FIG. 1 is a perspective view illustrating a preferred embodiment of the invention.
Figure 2:
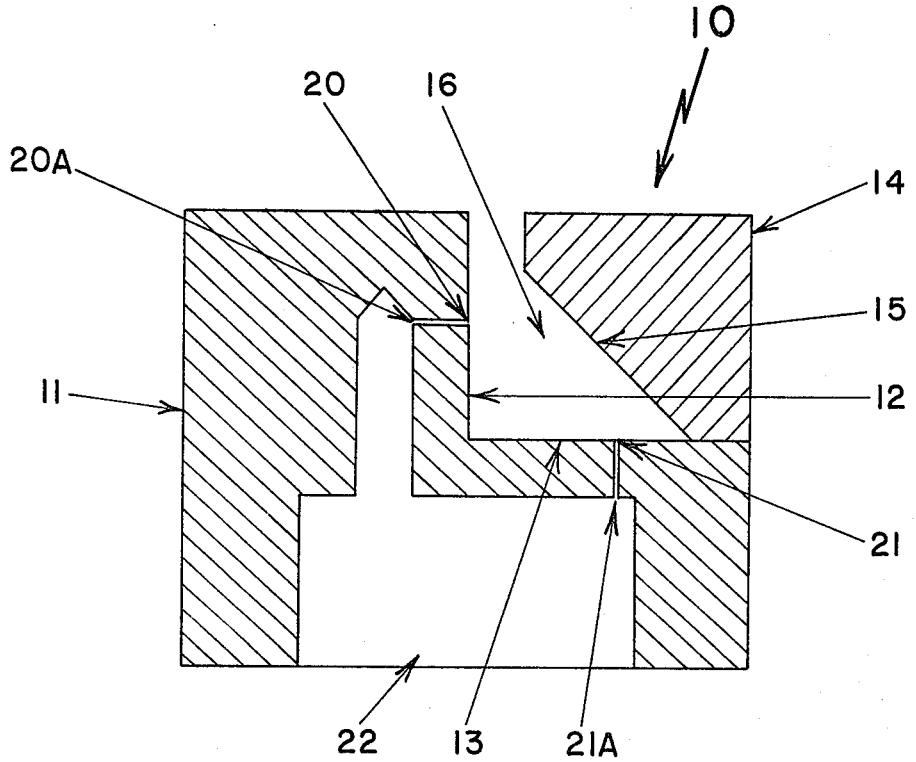
FIG. 2 is a sectional view depicting the same embodiment shown in FIG. 1.

Referring now to FIGS. 1 & 2, there is shown a device (10), which is a preferred embodiment according to the present invention. Device (10) is provided with a body member (11), which has a first planar yarn treating face (12) and a second planar yarn treating face (13) positioned at a right angle to each other. Cover member (14), which is secured to body member (11), has a planar surface (15), which is spaced from first yarn treating face (12) to form yarn passageway (16). Surface (15) of cover member (14) is positioned so that an angle of about 45 degrees is formed as shown in FIG. 1 by the intersection of the following:

(a) a line—e.g., (17)—resulting from the intersection of surface (15) and any plane which is mutually perpendicular to surface (15) and to yarn treating faces (12) and (13); and (b) a line—e.g., (18)—resulting from the intersection of such a perpendicular plane and second yarn treating face (13). Any standard means (19) is employed to control the velocity and direction of travel of multifilament yarn (23) into and out of yarn passageway (16), most desirably in a traversing movement, as hereinafter more particularly detailed. Fluid conduits (20A) and (21A) are provided in body member (11), the conduits terminating perpendicularly to yarn treating faces (12) and (13) in orifices (20) and (21), respectively, which are positioned to direct fluid against surface (15) of cover member (14). The longitudinal axes of conduits (20A) and (21A) at the terminations thereof in orifices (20) and (21), respectively, lie in one plane which is mutually perpendicular to surface (15) of cover member (14) and to yarn treating faces (12) and (13). It should be pointed out that the intersection of the axes of conduits (20A) and (21A) need not lie in the plane of surface (15) of cover member (14). Fluid is supplied to conduits (20A) and (21A) through means (22), which is conveniently a chamber in body member (11) communicating with a source of supply of fluid (not shown). Interlacing of the filaments of multifilament yarn (23) is accomplished as yarn (23) passes most desirably in a traversing movement into, "dwells" in, and exits from the yarn passageway (16) as yarn (23) travels from source of supply through yarn passageway (16) and thence to take-up. Movement of yarn (23) into the yarn passageway (16) is aided by aspiration caused by fluid flow. Most energetic interlacing occurs when the yarn (23) passes in close proximity to orifice (20), which happens twice during each traverse cycle. Accordingly, means (19) may be caused to move the yarn in the directions shown by the arrows in FIG. 1, in order to effect such a traversing movement. For purposes of convenience, the embodiment depicted in FIGS. 1 & 2 is referred to herein as a "yarn treating element".

Figure 3:
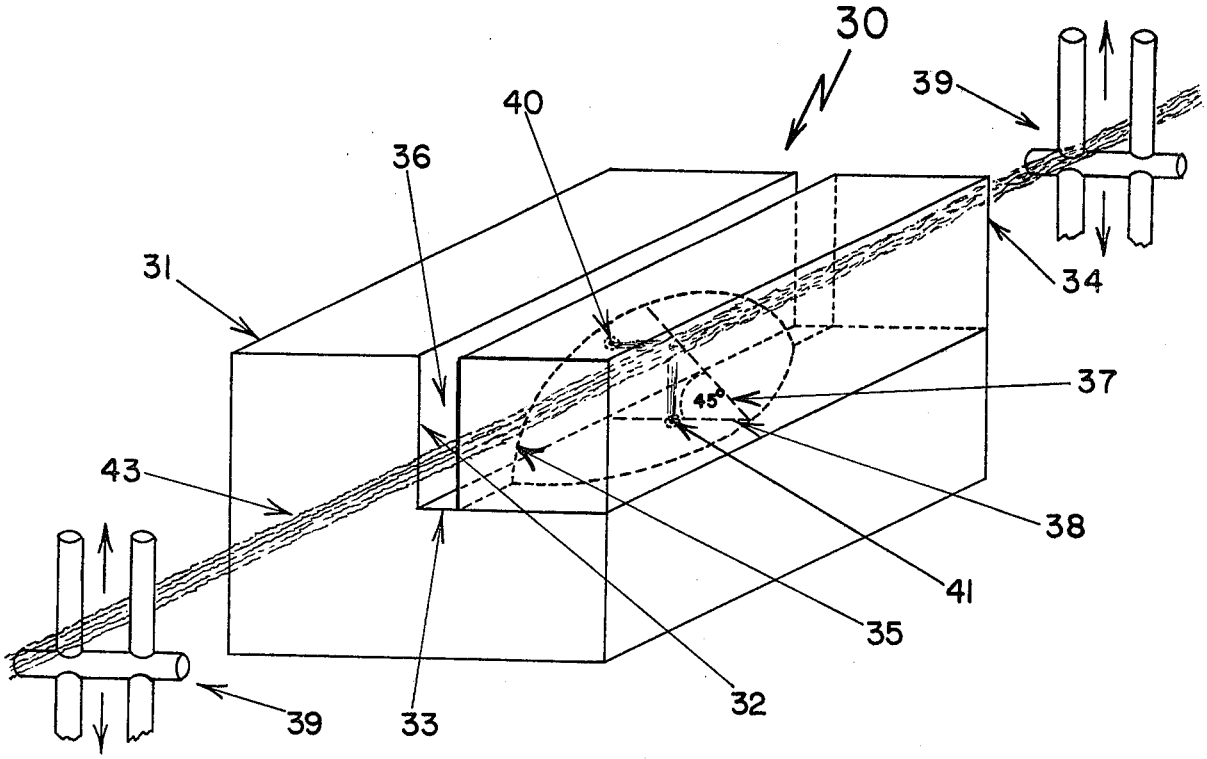
FIG. 3 is a perspective view illustrating an alternate embodiment of the invention shown in FIG. 1.
Figure 4:
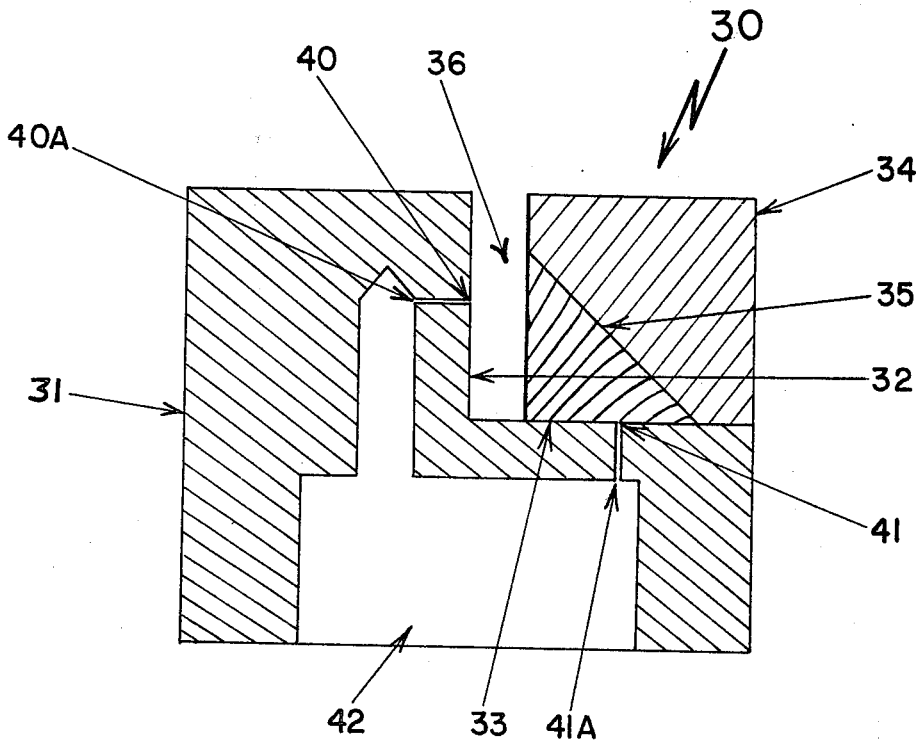
FIG. 4 is a sectional view depicting the same embodiment shown in FIG. 3.

An alternate "yarn treating element" according to the present invention is the especially preferred embodiment shown in FIGS. 3 and 4. This embodiment is device (30), which is provided with a body member (51) having a first planar yarn treating face (32) and a second planar yarn treating face (33) positioned at a right angle to each other. Cover member (34), which is secured to body member (31), has a concave, partial conical surface (35), as seen in FIG. 3, which is spaced from first yarn treating face (32) to form yarn passageway (36). Surface (35) of cover member (34) is positioned so that an angle of about 45 degrees is formed as shown in FIG. 3 by the intersection of the following: (a) a line—e.g., (37)—resulting from the intersection of surface (35) and any plane passing through the conical axis of surface (35); and (b) a line—e.g., (38)—resulting from the intersection of such a plane passing through the conical axis of surface (35) and second yarn treating face (33). Any standard means (39) is employed to control the velocity and direction of travel of multifilament yarn (43) into and out of yarn passageway (36), most desirably in a traversing movement as hereinafter more particularly detailed. Fluid conduits (40A) and (41A) are provided in body member (31), the conduits terminating perpendicularly to yarn treating faces (32) and (33) in orifices (40) and (41), respectively, which are positioned to direct fluid against surface (35) of cover member (34). The longitudinal axes of conduits (40A) and (41A) at the terminations thereof in orifices (40) and (41), respectively, lie in one plane which is mutually perpendicular to surface (35) of cover member (34) and to yarn treating faces (32) and (33). Fluid is supplied to conduits (40A) and (41A) through means (42), which is conveniently a chamber in body member (31) communicating with a source of supply of fluid (not shown). Interlacing of the filaments of multifilament yarn (43) is accomplished as yarn (43) passes most desirably in a traversing movement, into, "dwells" in, and exits from yarn passageway (36) as yarn travels from source of supply through yarn passageway (36) and thence to take-up. Movement of yarn (43) into the yarn passageway (36) is aided by aspiration caused by the fluid flow. Most energetic interlacing occurs when the yarn (43) passes in close proximity to orifice (40), which happens twice during each complete traverse cycle. Accordingly, means (39) may be caused to move the yarn in the directions shown by the arrows in FIG. 3, in order to effect such a traversing movement. This "yarn treating element" provides especially good results in the interlacing of multifilament yarn. The cover member is easily machined, no snag points for the yarn are presented, and the yarn passageway is itself a type of "vortex chamber", as understood by those of skill in the art.

Figure 5:
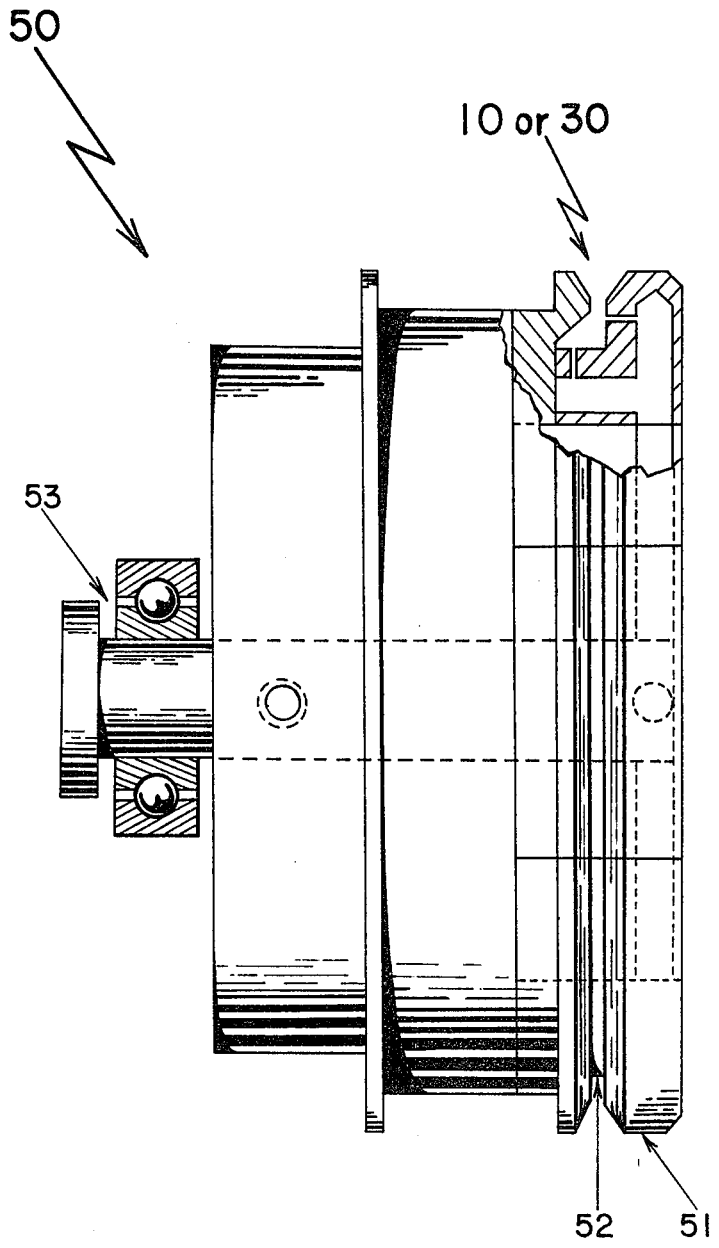
FIG. 5 is a partial sectional view illustrating an especially preferred embodiment which employs the embodiment of FIGS. 1–2 and/or the embodiment of FIGS. 3–4 in cooperative combination with certain additional elements.

The yarn treating elements of FIGS. 1–2 and FIGS. 3–4 as detailed above may be used alone, or if desired, in cooperative combination with the following additional elements to produce a pulley or interlacer roll (50) as shown in FIG. 5. One or more yarn treating elements (10) and/or yarn treating elements (30) are associated with disc (51), which has circumferential groove (52) formed on or near the periphery thereof so that groove (52) is aligned with the yarn passageway(s) of the yarn treating element(s) employed. Means is provided for causing the pulley or interlacer roll (50) to rotate (in bearing (53)) and a multifilament yarn to advance longitudinally at the same velocity as groove (52) of disc (51), as hereinafter explicated in detail with respect to FIG. 6. Under such conditions, the natural entrance of the yarn into and exit from the pulley or interlacer roll (50) effects a traversing movement of the yarn into and out of the yarn passageway(s) of the yarn treating element(s) employed.

Interlacing according to the present invention is advantageously carried out in conjunction with one or more common operations in the textile art, such as spinning and/or drawing, texturizing, and packaging. Under such conditions, advantage is taken of suitable yarn forwarding and take-up means, as understood by those of skill in the art.

Figure 6:
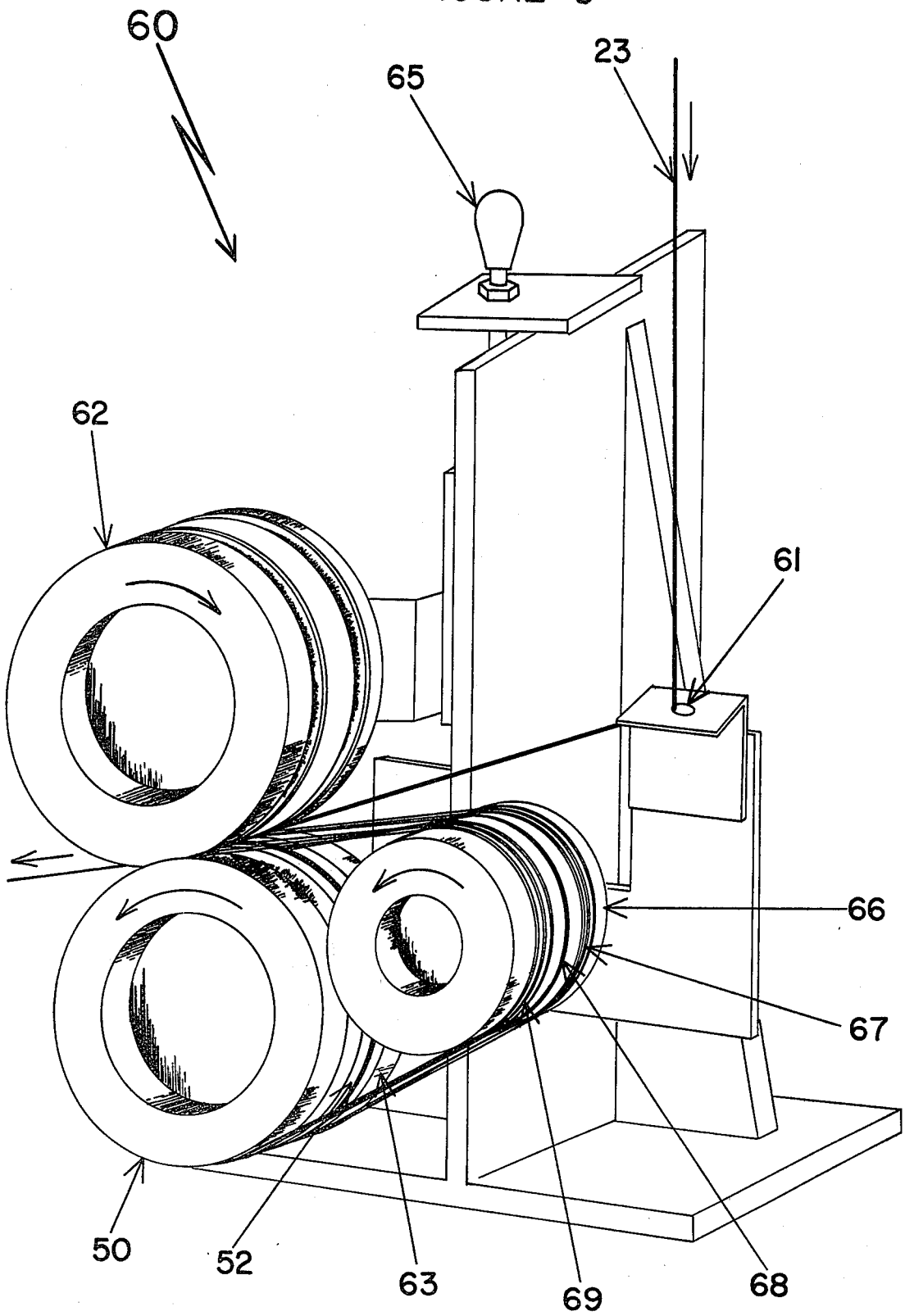
FIG. 6 schematically illustrates the actual utilization of an embodiment as shown in FIG. 5.

Referring now to FIG. 6, there is shown an integrated assembly (60), which is especially advantageously employed in the interlacing of multifilament yarn. Flat or textured multifilament yarn (23) having a denier of about 2600 is led in the direction shown under a tension of about 10 grams through inlet guide (61) to the nip between nip roll (62) and appended rear section (63) of interlacer roll (50). The longitudinal axes of rolls (62) and (50) are kept in substantially parallel alignment by means of alignment adjustor (65). It should be pointed out that yarn tensions of as high as 500 grams/2600 denier up to the nip have been employed with success, and yarn deniers of about 700 to 7000 have been utilized with beneficial results. Although the multifilament yarn is under tension before entering the interlacing section of the integrated assembly, e.g., up to the nip, the yarn is purposefully placed under substantially zero tension within the interlacing section, which is hereinafter specified further. It is preferable though not essential, that the yarn entering the interlacing section have a temperature appreciably higher than ambient to increase the limberness of the filaments especially when the yarn is caused to travel at high speeds, e.g., 300 meters/minute and greater. Further specification in this regard is impossible, however, as it is presently not technically possible to measure the temperature of the yarn core per se. Absolutely dry yarn has been found to be difficult to interlace, and very moist yarns have been found unacceptable because of undesirable adherence of the individual filaments. Yarns having a moisture level of from about 1 to about 10 percent by weight have been employed with beneficial results. In respect to denier per filament—(dpf), it has been found that the lower the dpf, the greater the degree of filament interlacing, all else being equal. In the practice of the present invention, multifilament yarns having a dpf of both 10 and 20 have been interlaced with equal success.

After passing through the nip between nip roll (62) and the appended rear section (63) of interlacer roll (50), yarn (23) is caused to pass around separator roll (66) a plurality of times inside inlet grooves (67), whence the yarn (23) enters circumferential groove (52) of interlacing roll (50) (wherein interlacing is effected) and passes around separator roll (66) inside center groove (68). Center groove (68) is cut deeply into separator roll (66) so that it may serve as an effective means for positioning yarn (23) within circumferential groove (52) and maintaining it therein while interlacing takes place. Upon exiting from circumferential groove (52), yarn (23) is caused to pass around separator roll (66) and the forward section of interlacer roll (50) a plurality of times by means of outlet grooves (69), whence it is directed from the integrated assembly (60) in the direction shown by the arrow to a suitable means (not shown) for winding the yarn on a package. Air pressures of from 20 to 200 psig have been employed with success in the supply of fluid to conduits 20A and 21A (or 40A and 41A)—see FIGS. 2, 4, and 5. The speed of advance of the yarn through integrated assembly (60) (especially through circumferential groove (52) is not critical—i.e., speeds of advance of from 300–2000 meters/minute have been employed without any discernable effect upon the efficiency of interlacing.

Yarn (23) which has passed through integrated assembly (60) under conditions specified above has been effectively interlaced at specific nodes in a random pattern and in sufficient numbers, so that yarn (23) has outstanding utility in standard carpet tufting processes.

The device of the present invention has been specified in detail with respect to certain preferred embodiments thereof. As is understood by those of skill in the art, variations in this detail may be effected without any departure from the spirit and scope of the present invention, as defined in the hereto-appended claims.

We claim:

1. A device for interlacing multifilament yarn, which device comprises the cooperative combination of:

(a) a body member having two planar orthogonal yarn-treating faces;

(b) a cover member secured to the body member, the cover member having a coacting surface which is spaced from the first yarn-treating face to form a yarn passageway, the coacting surface of the cover member so positioned with respect to the yarn-treating faces that an angle of about 45 degrees is formed by the intersection of: (1) a line resulting from the intersection of the coacting surface and any plane mutually orthogonal to the coacting surface and to the yarn-treating faces and (2) a line resulting from the intersection of said orthogonal plane and the second yarn-treating face;

(c) means for controlling the velocity and direction of travel of a multifilament yarn into and out of the yarn passageway;

(d) a coactive pair of fluid conduits in the body member, one conduit terminating perpendicularly to each of the yarn-treating faces in an orifice therein which is positioned to direct fluid against the coacting surface of the cover member, the longitudinal axes of the conduits at the terminations thereof lying in a plane mutually orthogonal to the coacting surface and to the yarn-treating faces; and (e) means for the supply of fluid to the conduits.

2. The device of claim 1, wherein the coacting surface of the cover member is a planar surface.

3. The device of claim 2, wherein the means of controlling the velocity and direction of travel of the yarn effects a traversing movement of the yarn into and out of the yarn passageway.

* * * * *